US011346637B1

(12) United States Patent
Steinmetz

(10) Patent No.: US 11,346,637 B1
(45) Date of Patent: May 31, 2022

(54) RANGE FINDER WITH BOW RELEASE

(71) Applicant: Brandon D. Steinmetz, Williston, ND (US)

(72) Inventor: Brandon D. Steinmetz, Williston, ND (US)

( * ) Notice: Subject to any disclaimer, the term of this patent is extended or adjusted under 35 U.S.C. 154(b) by 0 days.

(21) Appl. No.: 17/149,061

(22) Filed: Jan. 14, 2021

(51) Int. Cl.
*F41G 1/467* (2006.01)
*F41B 5/18* (2006.01)
*F41G 1/473* (2006.01)
*F41B 5/14* (2006.01)

(52) U.S. Cl.
CPC ..... *F41G 1/467* (2013.01); *F41B 5/1469* (2013.01); *F41G 1/473* (2013.01)

(58) Field of Classification Search
CPC ..... F41G 1/467; F41G 1/473; F41B 5/1469
USPC ..... 124/35.2, 87; 33/265
See application file for complete search history.

(56) References Cited

U.S. PATENT DOCUMENTS 3,418,718 A * 12/1968 Current ..... F41G 1/467 124/87
3,667,444 A * 6/1972 Depatie ..... F41G 1/467 124/24.1
5,261,581 A * 11/1993 Harden, Sr. ..... F41B 5/1469 124/23.1
5,937,841 A * 8/1999 Summers ..... F41B 5/1469 124/35.2
6,484,710 B1 * 11/2002 Summers ..... F41B 5/1469 124/35.2
7,314,045 B2 * 1/2008 Eckert ..... F41B 5/1469 124/35.2
7,422,008 B1 * 9/2008 Tentler ..... F41B 5/1469 124/35.2
7,753,043 B1 * 7/2010 Eckert ..... F41B 5/1469 124/35.2
8,225,517 B2 * 7/2012 Behr ..... G01C 3/02 33/265
8,272,137 B2 * 9/2012 Logsdon ..... F41G 1/467 33/265
8,276,282 B2 * 10/2012 Mainsonneuve ..... F41G 1/467 33/265
8,365,423 B2 * 2/2013 Humpert ..... G01C 3/00 33/265
8,826,551 B2 * 9/2014 Gibson ..... F41G 1/473 33/265
8,899,220 B2 * 12/2014 Morris, II ..... F41G 1/345 124/86
9,429,392 B1 * 8/2016 Ledbetter ..... F41B 5/1469
9,568,278 B1 * 2/2017 Jordan ..... F41G 1/467
(Continued)

*Primary Examiner* — Alexander R Niconovich
(74) *Attorney, Agent, or Firm* — Cramer Patent & Design, PLLC; Aaron R. Cramer

(57) ABSTRACT

The range finder bow release may comprise a cuff, a support armature, a bow release, and a range finder. The cuff may be adapted to be worn on a forearm of an archer. The support armature may be coupled to the cuff and may be adapted to position the bow release adjacent to a hand of the archer. The bow release may be a mechanical aid for releasing a bow string more precisely than the archer's fingers. The range finder may be an optical instrument that is operable to determine the distance to a target. The range finder may be coupled to the cuff and may be adapted to be used by the archer when the archer bends an elbow, brings the range finder up to an eye, and views the target through the range finder.

18 Claims, 8 Drawing Sheets

(56) References Cited

U.S. PATENT DOCUMENTS

| | | | | |
|---|---|---|---|---|
| 9,797,685 | B2 * | 10/2017 | Finley | F41B 5/1469 |
| 9,797,686 | B2 * | 10/2017 | Chesney | F41G 1/467 |
| 10,156,425 | B2 * | 12/2018 | Finley | F41B 5/1469 |
| 2008/0216331 | A1 * | 9/2008 | Jones | F41G 1/467<br>33/265 |
| 2009/0095270 | A1 * | 4/2009 | Graves | F41B 5/1469<br>124/35.2 |
| 2013/0174821 | A1 * | 7/2013 | Jones | F41B 5/1469<br>124/35.2 |

* cited by examiner

RANGE FINDER WITH BOW RELEASE

RELATED APPLICATIONS

Not applicable.

FIELD OF THE INVENTION

The present invention relates generally to a range finder and more specifically to a range finder with a bow release.

BACKGROUND OF THE INVENTION

The hobby of bow hunting or target archery shooting is enjoyed by many. Of those who participate in the sport, many find that a bow release improves their shooting skills. The bow release is almost a necessity with modern technology bows and a clean, accurate shot is virtually guaranteed every time. Many users also rely on optical range finders to determine the distance to their intended target.

Unfortunately, these range finders are normally designed for hunting at up to 2,000 feet away. This results in reduced accuracy at the typical limit of most bow users of fifty (50) yards. Additionally, the range finder is another separate component which must be carried and results in fumbling for use during times when speed, accuracy, and stealth like action is of the utmost importance. Accordingly, there exists a need for a means by which an optical range finder can be modified for bow use in a manner that addresses the above concerns. The development of the range finder with bow release fulfills this need.

SUMMARY OF THE INVENTION

To achieve the above and other objectives, the present invention provides for a range finder bow release has a cuff adapted to be worn on a forearm of an archer, a support armature which is coupled to the cuff, a bow release which has a mechanical aid which is adapted to release a bow string, and a range finder for determining a distance to a target. The archer has a hand with a plurality of fingers, a palm, and a forearm. The support armature has a first end and a second end. The support armature positions the bow release which is adjacent to the hand of the archer.

The cuff is a cylindrical strap that may be adapted to be worn on the archer's forearm. The cuff may include an opening such that the cuff separates at an opening for donning and removal. The range finder bow release may further comprise one or more fasteners which may retain the opening closed while the cuff is worn. The cuff may be made of an elastic that is stretched for donning and removal. The first end of the support armature may couple to the cuff. The support armature may extend from the cuff.

The distal end of the support armature may be coupled to the bow release such that the support armature may be adapted to hold the bow release adjacent to the archer's hand. The mechanical aid of the bow release may be adapted to release the bow string quicker and with less induced torque compared to a release by the archer's fingers. The bow release may be adapted to retain a D-loop of the bow string until the bow release is activated by the archer using a trigger. The D-loop may be a loop that couples to the bow string above and below an arrow such that the bow release pulls the bow string via the D-loop without interfering with nocking the arrow. The bow release may retain the bow string until the trigger is depressed. The bow release may retain the bow string until the trigger is released.

A body of the bow release may be sized and contoured to fit within the palm of the archer's hand with the range finder oriented perpendicular to the body of the bow release. The range finder may be adapted to present an indicia which the archer views when looking at the target through an eyepiece. The indicia may be calibrated to a plurality of dimensions of the target. The range finder may be an optical instrument for measuring a distance. The range finder may also be coupled to the cuff such that the range finder may be oriented to be perpendicular to the support armature and to the forearm of the archer. The range finder may provide a split-image and/or microprism focusing aid where the distance to the target is read from a focusing ring or an in-eyepiece indicator when a focused image is achieved. The range finder bow release may also comprise a plurality of control electronics, a battery, an operator control, or any such combinations.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
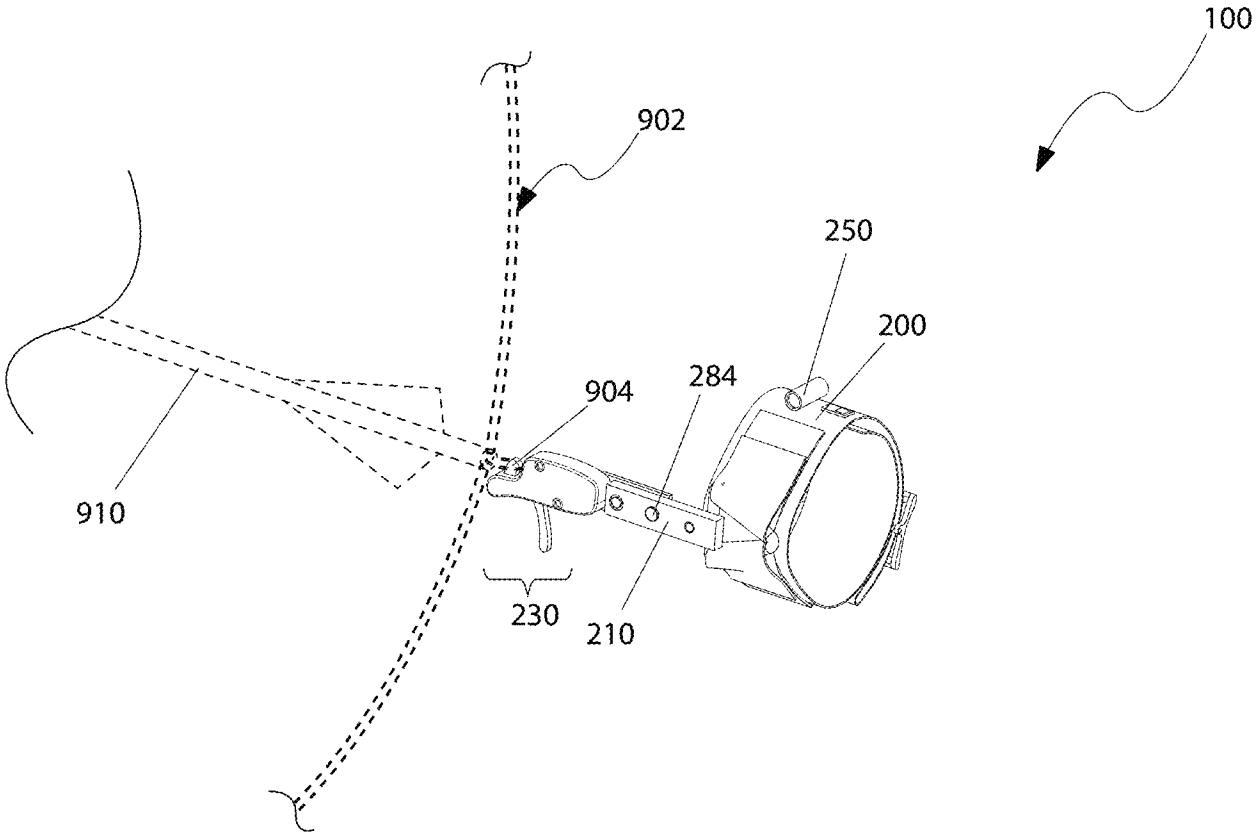
FIG. 1 is an in-use view of a range finder bow release, according to an embodiment of the present invention.
Figure 2:
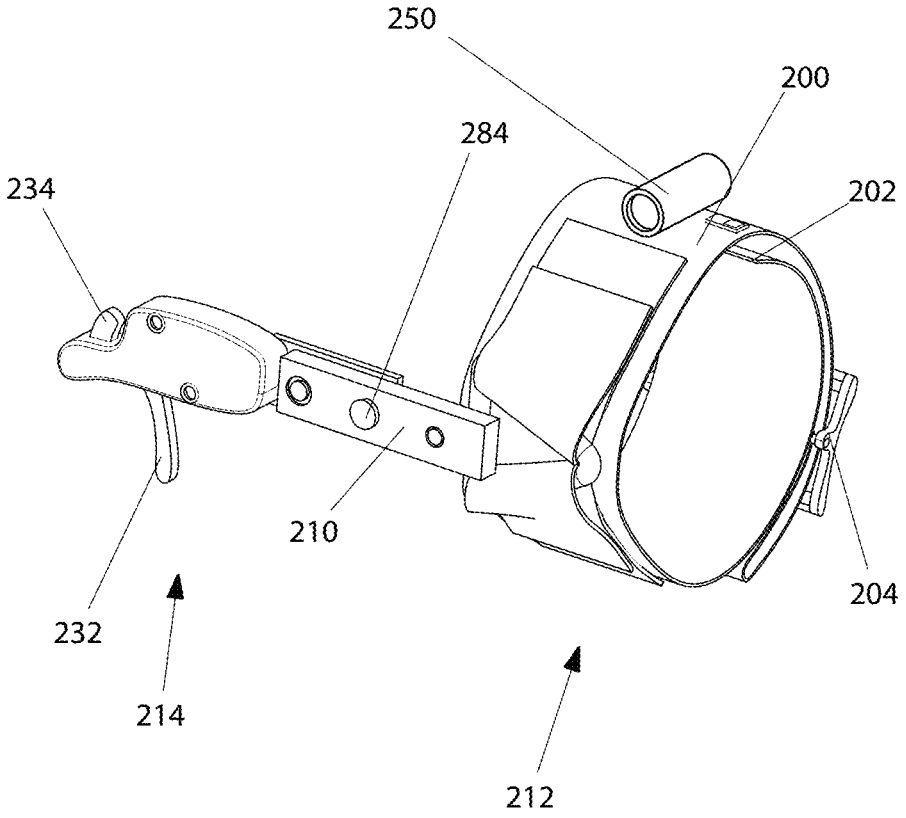
FIG. 2 is an isometric view of a range finder bow release, according to an embodiment of the present invention.
Figure 3:
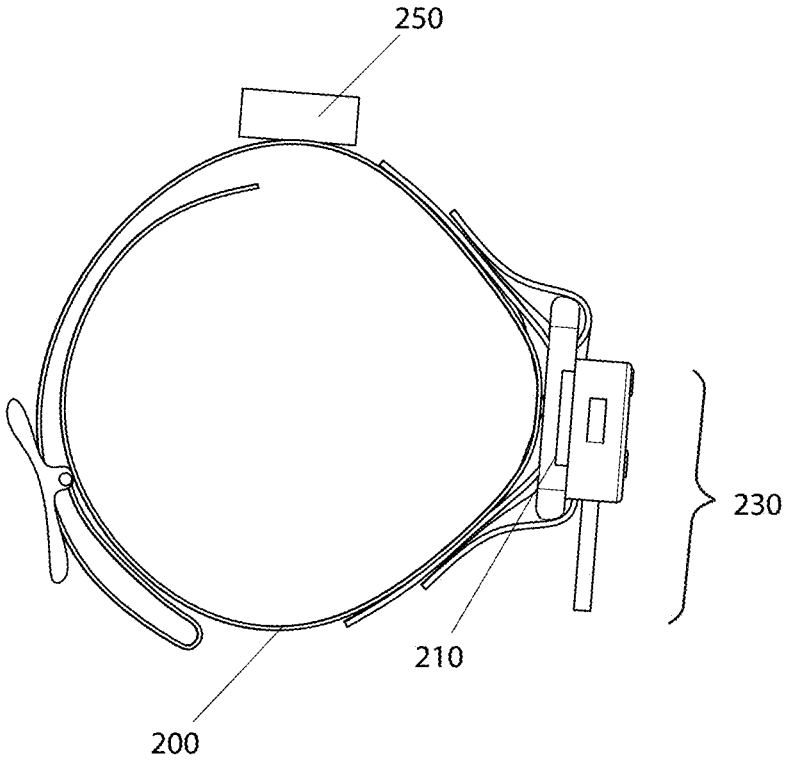
FIG. 3 is a front view of a range finder bow release, according to an embodiment of the present invention.
Figure 4:
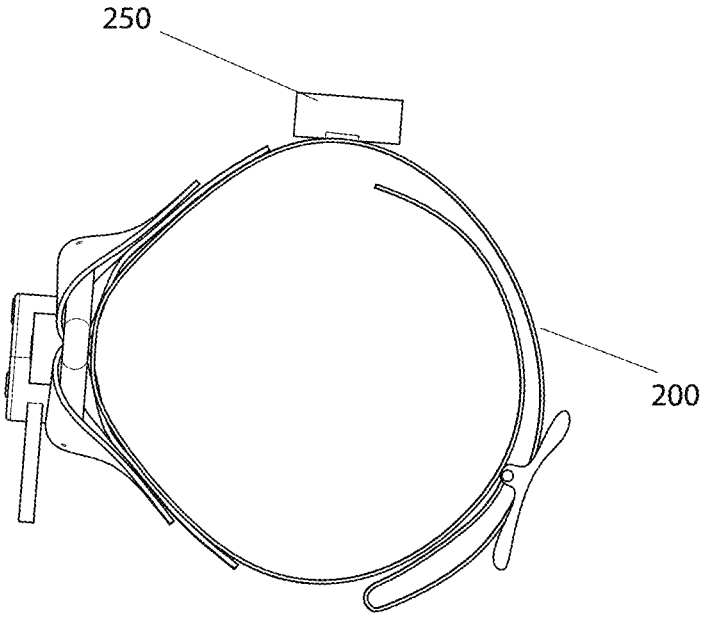
FIG. 4 is a rear view of a range finder bow release, according to an embodiment of the present invention.
Figure 5:
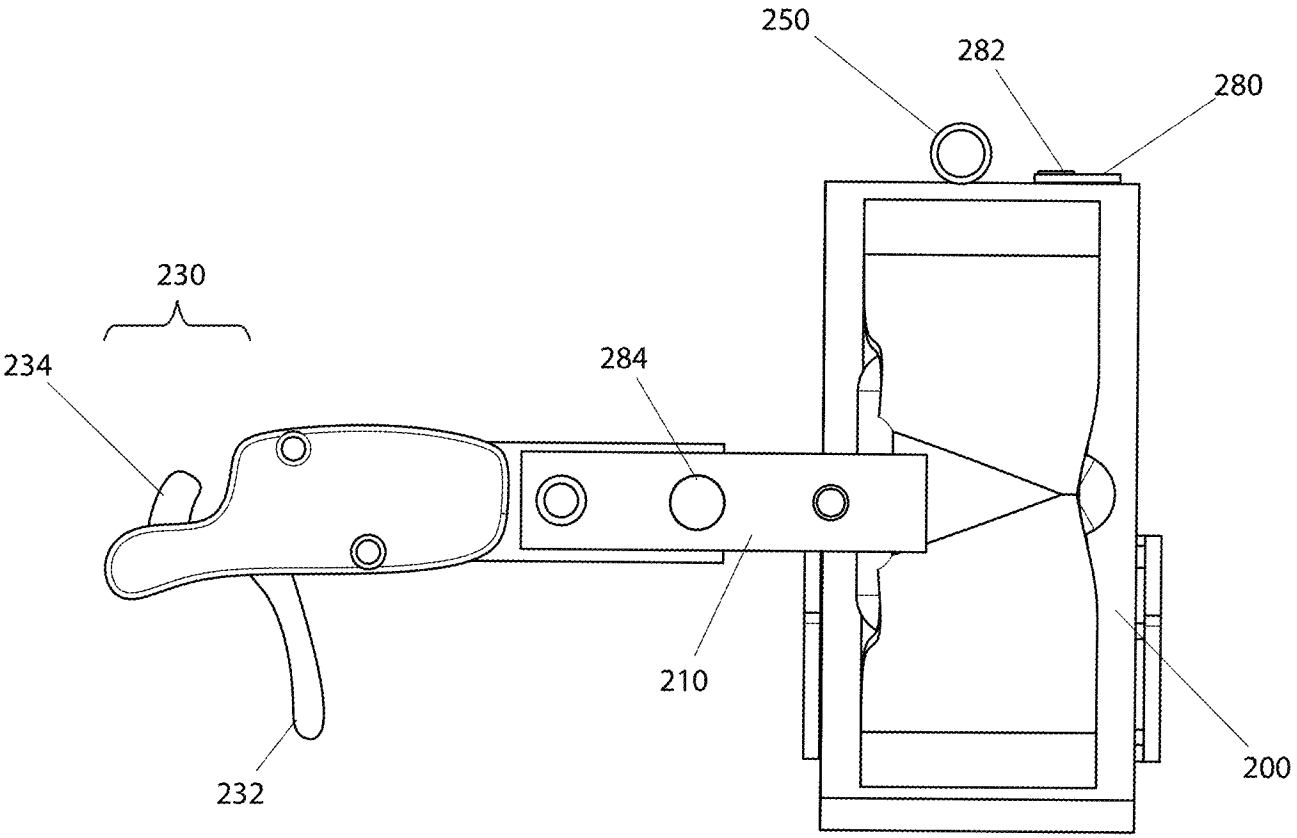
FIG. 5 is a side view of a range finder bow release, according to an embodiment of the present invention.

100 Range Finder Bow Release
200 Cuff
202 Opening
204 Fastener
210 Support Armature
212 Proximal End
214 Distal End
230 Bow Release
232 Trigger
234 D-Loop Hook
238 Body
250 Range Finder
252 Eyepiece
254 Indicia
256 Image
258 Distance Interval
260 Reference Mark
270 Bottom Mark
272 Top Mark
280 Battery

282 Control Electronics
284 Operator Control
902 Bow String
904 D-Loop
910 Arrow

DESCRIPTION OF THE INVENTION

The present invention is directed to a range finder bow release (herein described as the "invention") 100. The invention 100 may comprise a cuff 200, a support armature 210, a bow release 230, and a range finder 250. The cuff 200 may be adapted to be worn on a forearm of an archer. The support armature 210 may be coupled to the cuff 200 and may be adapted to position the bow release 230 adjacent to a hand of the archer. The bow release 230 may be a mechanical aid for releasing a bow string 902 more precisely than the archer's fingers. The range finder 250 may be operable to determine the distance to a target.

The cuff 200 may be a cylindrical strap that is adapted to be worn on the forearm. The cuff 200 may be adjustable in size. As a non-limiting example, the cuff 200 may be made of an elastic material that may be stretched for donning and removal. In some embodiments, the cuff 200 may comprise an opening 202 such that the cuff 200 may separate at the opening 202 for donning and removal. One (1) or more fasteners 204 may retain the opening 202 closed while the cuff 200 is being worn. As a non-limiting example, the one or more fasteners 204 may be a hook-and-loop-style fastener. Refer to FIGS. 2, 3, 4, and 5.

The support armature 210 may be defined by a proximal end 212 and a distal end 214. The proximal end 212 of the support armature 210 may couple to the cuff 200. The support armature 210 may extend forward from the cuff 200. The distal end 214 of the support armature 210 may be coupled to the bow release 230 such that the support armature 210 may be adapted to hold the bow release 230 adjacent to the hand.

The bow release 230 may be a mechanical aid that is adapted to release the bow string 902 more quickly and with less induced torque compared to a release by fingers of the archer. In some embodiments, the bow release 230 may be adapted to retain a D-loop 904 of the bow string 902 until the bow release 230 is activated by the archer using a trigger 232. The D-loop 904 may be a loop that couples to the bow string 902 above and below an arrow 910 such that the bow release 230 may pull the bow string 902 via the D-loop 904 without interfering with nocking of the arrow 910. Refer to FIG. 1.

In some embodiments, activation of the bow release 230 may be a positive release. Positive release may refer to the bow release 230 retaining the bow string 902 until the trigger 232 is depressed.

In some embodiments, activation of the bow release 230 may be a negative release. Negative release may refer to the bow release 230 retaining the bow string 902 until the trigger 232 is released. As a non-limiting example, the bow release 230 may comprise the trigger 232 and a D-loop hook 234 that pivot at a release pivot such that movement of the trigger 232 may result in a corresponding movement of the D-loop hook 234. The D-loop hook 234 may engage the D-loop 904 such that the D-loop hook 234 pulls the bow string 902 as the bow release 230 is pulled rearwards. The D-loop hook 234 may be adapted to remain engaged with the D-loop 904 while the finger of the archer presses against the trigger 232 in a negative release embodiment. The D-loop 904, and hence the bow string 902, may be adapted to released when the finger of the archer releases the trigger 232 and permits the D-loop hook 234 to disengage from the D-loop 904. Releasing the bow string 902 may propel the arrow 910 forward.

The range finder 250 may be an optical instrument for measuring a distance. The range finder 250 may be adapted to inform the archer of the distance to the target when the archer looks at the target through the range finder 250. The range finder 250 may be coupled to the cuff 200 such that the range finder 250 is oriented to be perpendicular to the support armature 210 and to the forearm of the archer. The range finder 250 may be adapted to be used by the archer when the archer bends an elbow by ninety degrees (90°), brings the range finder 250 up to an eye, and views the target through the range finder 250. Once the distance to the target has been determined, the archer may nock the arrow 910 and draw the bow string 902 using the bow release 230. The archer may adjust the draw according to the distance that was determined using the range finder 250. As non-limiting examples, the archer may adjust the draw length and/or elevation angle.

Figure 6:
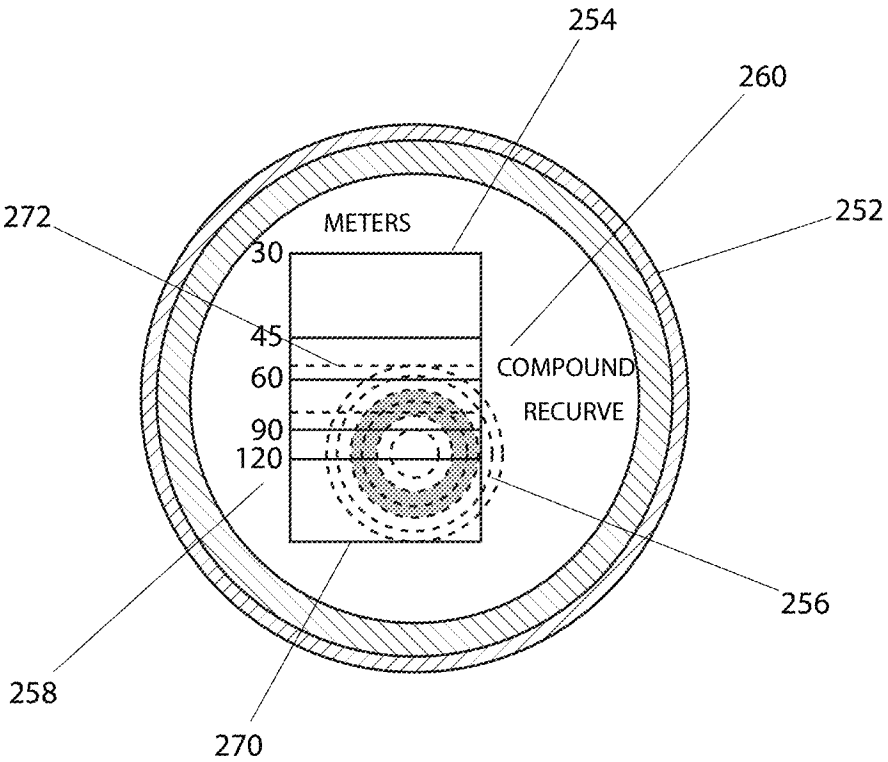
FIG. 6 is a detail view of a range finder bow release, according to an embodiment of the present invention illustrating a view through a range finder.

In some embodiments, the range finder 250 may be adapted to present indicia 254 which the archer views when looking at the target through an eyepiece 252. The indicia 254 may be calibrated to the size of a standard size target. As a non-limiting example, the indicia 254 may show distance intervals 258 that may be matched to an image 256 of the standard size target by positioning the bottom of the image 256 of the standard size target at a bottom mark 270 and reading the distance from a top mark 272 that appears at the top of the image 256 of the standard size target. As non-limiting examples, the distance intervals 258 may be calibrated and marked to correspond to a distance measured in yards, a distance measured in meters, or both. In some embodiments, the indicia 254 may comprise one (1) or more reference marks 260 corresponding to regulation distances for specific distances. Refer to FIG. 6. In some embodiments, the indicia 254 may be calibrated to the size of a typical buck or other hunted animal instead of a competition target.

In some embodiments, the range finder 250 may be operable to determine the distance to the target by indicating the distance that corresponds to a focused image of the target as viewed in the eyepiece 252. As non-limiting examples, the optics of the range finder 250 may provide split-image and/or microprism focusing aids and the distance to the target may be read from a focusing ring or in-eyepiece indicator when the focused image is achieved.

In some embodiments, the range finder 250 may comprise a laser and an optical sensor to determine the distance to the target. As a non-limiting example, the laser may illuminate a point on the target and the optical sensor may determine where in the optical field of the range finder 250 a reflected spot of laser light appears. The range finder 250 may use trigonometry to calculate the distance to the target based upon the position of the reflected spot of laser light.

In some embodiments, the invention 100 may comprise control electronics 282, a battery 280, an operator control 284, or combinations thereof. The control electronics 282 may control the operation of the range finder 250. As a non-limiting example, the control electronics 282 may initiate a distance measurement by the range finder 250 when the operator control 284 is activated and/or may deactivate the range finder 250 after a time-out to conserve the life of the battery 280. The battery 280 may provide an electrical potential to operate the range finder 250 and/or the control electronics 282. The operator control 284 may initiate a distance measurement by the range finder 250.

Figure 7:
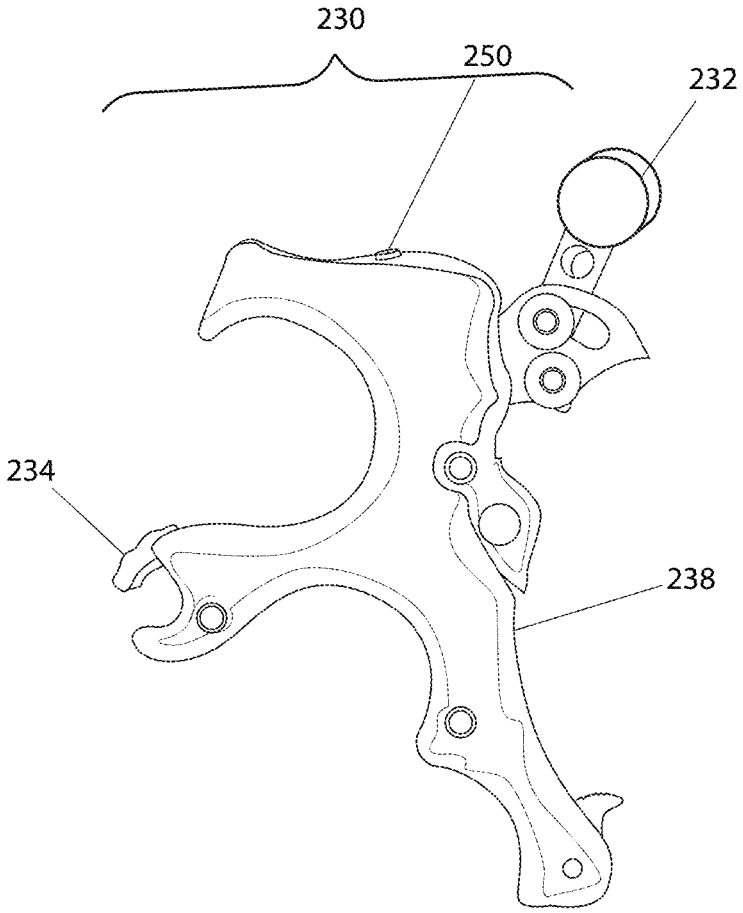
FIG. 7 is a side view of a range finder bow release, according to an alternative embodiment of the present invention illustrating a hand-held embodiment; and, FIG. 8 is an in-use view of a range finder bow release, according to an alternative embodiment of the present invention.
Figure 8:
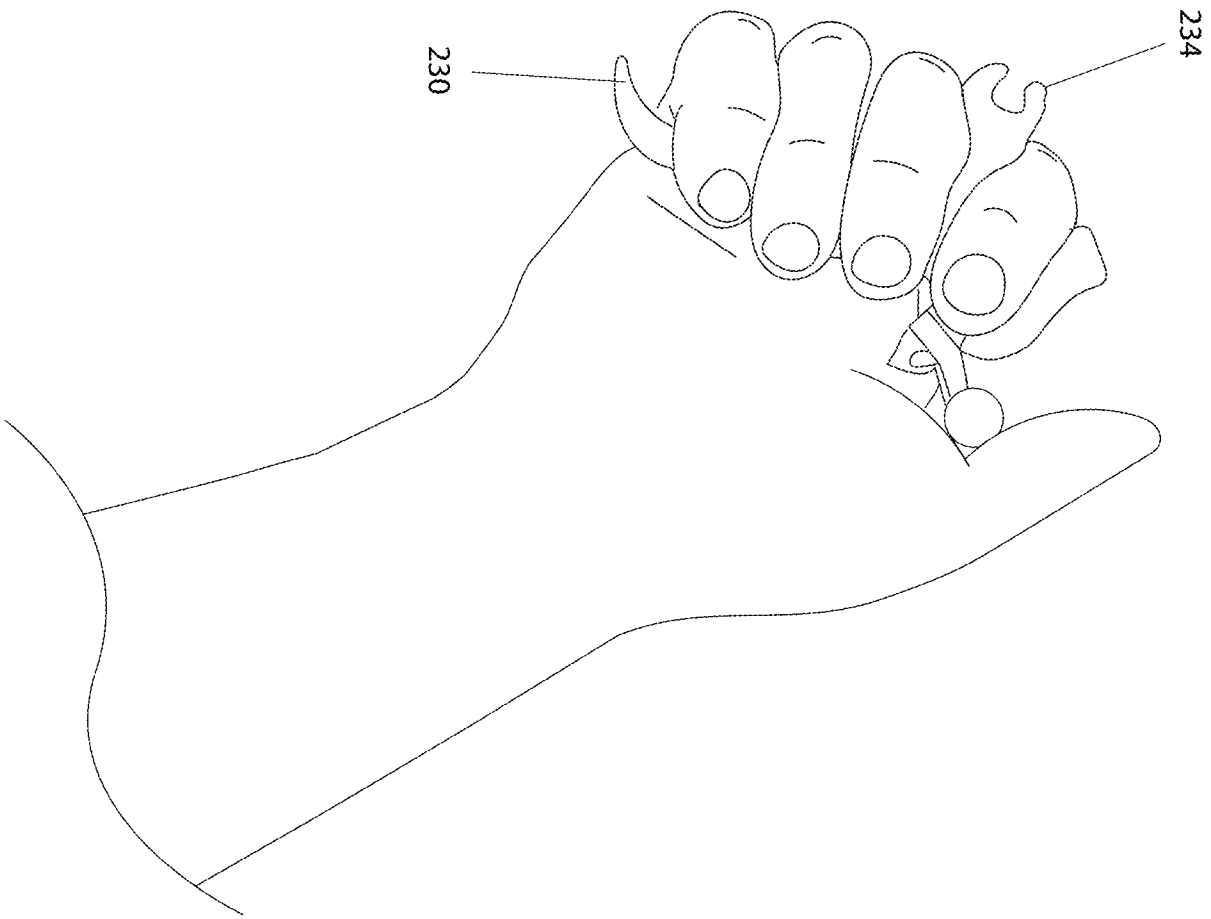

In an alternative embodiment, a body 238 of the bow release 230 may be sized and contoured to fit within the palm of the hand with the range finder 250 oriented perpendicular to the body 238 of the bow release 230. In such an embodiment, the archer may bring the hand up to the eye to determine the range to the target using the range finder 250 and may then lower the hand and grasp the D-loop 904 with the bow release 230. In some embodiments, the range finder 250 may be integrated within the body 238. The bow release 230 is operable to release the bow as the trigger 232 which the archer may activate with a thumb in order to release the bow string 902 (please see FIGS. 7 and 8).

Although the invention 100 has been presented here illustrated as fitting on a right arm or held by a right hand, those skilled in the art will recognize that alternative embodiments exist in which some elements of the invention 100 may be reversed and/or reoriented to fit on a left arm or a left hand and that such alternative embodiments are within the spirit and scope of the invention 100.

In use, the archer dons the cuff 200 with the support armature 210 extending forward towards the hand such that the bow release 230 is adjacent to the palm of the hand. The archer may bend their elbow to bring the range finder 250 up to their eye and may determine the distance to the target. The archer may nock the arrow 910 and couple the D-loop hook 234 of the bow release 230 to the D-loop 904 on the bow string 902. The archer may draw the bow string 902 and may adjust the draw and/or aiming point according to the determined distance to the target. The archer may release the bow string 902 and shoot the arrow 910 by activating the trigger 232 on the bow release 230.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A range finder bow release, comprising:

a cuff adapted to be worn on a forearm of an archer, the archer having a hand with a plurality of fingers, a palm, and a forearm;

a support armature coupled to the cuff, the support armature having a first end and a second end;

a bow release having a mechanical aid adapted to release a bow string, the support armature positions the bow release adjacent to the hand of the archer;

a range finder determining a distance to a target and, wherein a body of the bow release is sized and contoured to fit within the palm of the archer's hand with the range finder oriented perpendicular to the body of the bow release; and, wherein the range finder is coupled to the cuff such that the range finder is oriented to be perpendicular to the support armature and to the forearm of the archer.

2. The range finder bow release, according to claim 1, wherein the cuff is a cylindrical strap that is adapted to be worn on the archer's forearm.

3. The range finder bow release, according to claim 1, wherein the cuff includes an opening such that the cuff separates at an opening for donning and removal.

4. The range finder bow release, according to claim 3, further comprising one or more fasteners retaining the opening closed while the cuff is worn.

5. The range finder bow release, according to claim 1, wherein the cuff is made of an elastic that is stretched for donning and removal.

6. The range finder bow release, according to claim 1, wherein the first end of the support armature couples to the cuff.

7. The range finder bow release, according to claim 1, wherein the support armature extends from the cuff.

8. The range finder bow release, according to claim 1, wherein the distal end of the support armature is coupled to the bow release such that the support armature is adapted to hold the bow release adjacent to the archer's hand.

9. The range finder bow release, according to claim 1, wherein the mechanical aid of the bow release is adapted to release the bow string quicker and with less induced torque compared to a release by the archer's fingers.

10. The range finder bow release, according to claim 1, wherein the bow release is adapted to retain a D-loop of the bow string until the bow release is activated by the archer using a trigger.

11. The range finder bow release, according to claim 10, wherein the D-loop is a loop that couples to the bow string above and below an arrow such that the bow release pulls the bow string via the D-loop without interfering with nocking the arrow.

12. The range finder bow release, according to claim 10, wherein the bow release retaining the bow string until the trigger is depressed.

13. The range finder bow release, according to claim 10, wherein the bow release is retaining the bow string until the trigger is released.

14. The range finder bow release, according to claim 1, wherein the range finder is adapted to present an indicia which the archer views when looking at the target through an eyepiece.

15. The range finder bow release, according to claim 14, wherein the indicia is calibrated to a plurality of dimensions of the target.

16. The range finder bow release, according to claim 1, wherein the range finder is an optical instrument for measuring a distance.

17. The range finder bow release, according to claim 1, wherein the range finder provides a split-image and/or microprism focusing aid where the distance to the target is read from a focusing ring or an in-eyepiece indicator when a focused image is achieved.

18. The range finder bow release, according to claim 1, further comprising a plurality of control electronics, a battery, an operator control, or any combinations thereof.

* * * * *